US005630200A

United States Patent [19]

Christy

[11] Patent Number: 5,630,200

[45] Date of Patent: May 13, 1997

[54] MULTI-ROLLER ELECTROSTATIC TONING SYSTEM APPLICATION TO TRI-LEVEL IMAGING PROCESS

[75] Inventor: Orrin D. Christy, North Tonawanda, N.Y.

[73] Assignee: Moore Business Forms, Inc., Grand Island, N.Y.

[21] Appl. No.: 466,365

[22] Filed: Jun. 6, 1995

[51] Int. Cl.[6] ..... G03G 15/08

[52] U.S. Cl. ..... 399/228; 399/292

[58] Field of Search ..... 355/328, 327, 355/326; 399/292, 293, 228, 232

[56] References Cited

U.S. PATENT DOCUMENTS

| | | | |
|---|---|---|---|
| 4,078,929 | 3/1978 | Gundlach . | |
| 4,731,634 | 3/1988 | Stark | 355/328 |
| 4,777,106 | 10/1988 | Fotland et al. . | |
| 4,868,600 | 9/1989 | Hays et al. . | |
| 4,937,636 | 6/1990 | Rees et al. | 355/328 |
| 4,959,286 | 9/1990 | Tabb . | |
| 5,045,893 | 9/1991 | Tabb | 355/328 |
| 5,049,949 | 9/1991 | Parker et al. . | |
| 5,087,538 | 2/1992 | Nelson | 430/45 |
| 5,121,172 | 6/1992 | Stover | 355/327 |
| 5,155,541 | 10/1992 | Loce et al. | 355/328 |
| 5,208,636 | 5/1993 | Rees et al. | 355/219 |
| 5,245,392 | 9/1993 | Behe et al. . | |

FOREIGN PATENT DOCUMENTS

| | | |
|---|---|---|
| 2059036 | 7/1992 | Canada . |
| 620505 | 10/1994 | European Pat. Off. . |

*Primary Examiner*—William J. Royer

*Attorney, Agent, or Firm*—Nixon & Vanderhye P.C.

[57] ABSTRACT

Images are formed using first and second fluidized beds of non-magnetic toner having first and second, respective, single applicator rollers. A charge retentive surface such as a photoconductive belt is uniformly charged (e.g. by a corona device) to a predetermined voltage level, and at least first and second different, spaced, latent electrostatic images are formed on the surface at different locations (such as by a laser based output scanning device). The surface is then moved past the first applicator roller, and then the second applicator roller. The first fluidized bed and applicator roller are electrically biased at a first bias level effective so that the first image is developed by a non-magnetic toner transferred from the first applicator roller to the first image while development of the second image is precluded, and the second fluidized bed and second applicator roller are electrically biased at a second bias level effective so that the second image is developed by non-magnetic toner transferred from the second applicator roller to the second image while development of the first image is precluded. A negative bias may be applied to the first fluidized bed and a positive bias to the second fluidized bed, while the first and second rollers are positively biased at voltage levels at least 50 volts different. Black toner may be applied by the first fluidized bed, and colored toner by the second bed. A transfer roller may be used to transfer toner from each of the fluidized beds to its associated applicator roller.

20 Claims, 5 Drawing Sheets

MULTI-ROLLER ELECTROSTATIC TONING SYSTEM APPLICATION TO TRI-LEVEL IMAGING PROCESS

BACKGROUND AND SUMMARY OF THE INVENTION

A series of effective methods and apparatus for multi-level imaging, such as found in the Xerox Corporation 4850 highlight color printer, are shown in U.S. Pat. Nos. 4,078,929, 4,868,600, 4,959,286, 5,049,949, and 5,245,392 (the disclosures of which are hereby incorporated by reference herein). These patents teach a tri-level process which utilizes a modulated laser beam to produce three distinct electrical levels of the latent image on an imaging belt (or other charge retentive surface). Most laser printers use a two level system, or simply an on/off for each imaged pixel. The above mentioned patents, however, use a writing laser beam that is time modulated, the electrostatic latent image being created by the laser beam imaging to three states which are full-on, half-on, and off.

While the multi-level imaging provided by the above mentioned patents is advantageous in a number of ways, there are several disadvantages associated therewith. For example U.S. Pat. No. 4,959,286 points out that a trade-off in using a tri-level imaging in lieu of two-pass imaging is the necessity of imaging three light levels within one frame (i.e. black, white, and colored), thereby cutting the voltage latitude in half or more. This necessitates using a high gamma development system such as a conductive magnetic brush. The toner developing stations utilized in such systems are the result of a considerable expenditure of technological effort and money. The developing systems are dual component toning systems which are complex and sophisticated both to construct and to operate. The voltage difference between the image and donor rollers in each case is about 300 volts, therefore making it necessary to use a variety of different types of techniques in order to achieve adequate image development. For example U.S. Pat. No. 5,245,392 uses a special biased wire to help form a powder cloud of charged toner above a donor roller to improve image development density. The utilization of dual donor (applicator) rollers in these systems is particularly expensive and disadvantageous.

According to the present invention it has been found that by utilizing a non-magnetic toning process and apparatus, such as disclosed in Canadian published patent application 2059036 (based upon U.S. application Ser. No. 07/639,360 filed Jan. 8, 1991, the disclosure of which is hereby incorporated by reference herein), a high gamma development system is provided which is significantly simpler than the prior art development systems for tri-level systems. The development system and method according to the present invention also have far fewer limitations on process speed and variability of process than in the conventional tri-level systems described in the above mentioned U.S. patents because the image potential of the toner is higher, and there is less dependence on toner charging and on the chemical make-up of the toner, providing an enhanced performance window of the tri-level (or other multi-level) imaging process.

According to one aspect of the present invention a method of forming images using first and second fluidized beds of non-magnetic toner, having first and second, respective, applicator rollers is provided. The method comprises the steps of substantially continuously: (a) Uniformly charging a charge retentive surface to a predetermined voltage level.

(b) Forming on the charge retentive so surface at different locations thereof at least first and second different, spaced, latent electrostatic images. (c) Moving the charge retentive surface past the first fluidized bed of non-magnetic toner, so that the charge retentive surface comes into operative association with the first applicator roller of the first fluidized bed. (d) Electrically biasing the first fluidized bed and the first applicator roller at a first bias level effective so that the first image is developed by non-magnetic toner transferred from the first applicator roller to the first image while development of the second image is precluded. (e) Moving the charge retentive surface past the second fluidized bed of non-magnetic toner, so that the charge retentive surface comes into operative association with the second applicator roller of the second fluidized bed. And, (f) electrically biasing the second fluidized bed and the second applicator roller at a second bias level, different than the first bias level of step (d), effective so that the second image is developed by non-magnetic toner transferred from the second applicator roller to the second image while development of the first image is precluded.

Typically each fluidized bed has a single applicator roller rather than the dual rollers provided in the prior art, greatly simplifying the system and method. In that case step (c) is practiced by bringing the charge retentive surface into operative association with the first, single, applicator roller, and step (e) is practiced by bringing the charge retentive surface into operative association with the second, single, applicator roller.

Typically step (d) is practiced by applying an electrical bias to the first fluidized bed of toner of a first polarity, and step (f) is practiced by applying an electrical bias to the second fluidized bed of toner of a second polarity. For example step (d) may be practiced to apply a negative electrical bias to the first fluidized bed, and step (f) to apply a positive electrical bias to the second fluidized bed. Steps (c) and (d) may be practiced to apply and develop black toner while steps (e) and (f) apply and develop colored toner. Step (d) may be practiced to apply a first positive voltage to the first applicator roller and step (f) to apply a second positive voltage to the second applicator roller, the second voltage at least 50 volts lower than the first voltage. For example step (d) may be practiced to apply a negative voltage of about 6700 volts to the first fluidized bed and a positive voltage of about 550 volts to the first applicator roller, while step (fi is practiced to apply a positive voltage of about 7600 volts to the second fluidized bed and a positive voltage of about 450 volts to the second applicator roller.

According to another aspect of the present invention image forming apparatus is provided comprising the following components: A movable charge retentive surface. Means for uniformly charging the charge retentive surface to a predetermined voltage level. Means for forming on the charge retentive surface at different locations thereof at least first and second different, spaced, latent electrostatic images. First and second spaced fluidized beds of non-magnetic toner, having first and second, respective, applicator rollers. Means for moving the charge retentive surface first past the first fluidized bed of non-magnetic toner, so that the charge retentive surface comes into operative association with the first applicator roller, and then moving the charge retentive surface past the second fluidized bed of non-magnetic toner, so that the charge retentive surface comes into operative association with the second applicator roller. Means for electrically biasing the first fluidized bed and the first applicator roller at a first bias level effective so that the first image is developed by non-magnetic toner transferred from the first applicator roller to the first image while development of the second image is precluded. And, means for electrically biasing the second fluidized bed and the second applicator roller at a second bias level, different than the first bias level, effective so that the second image is developed by non-magnetic toner transferred from the second applicator roller to the second image while development of the first image is precluded.

The first applicator roller preferably comprises a single applicator roller associated with the first fluidized bed, and the second applicator roller comprises a single applicator roller associated with the second fluidized bed. The movable charge retentive surface may comprise a web, cylinder, or other conventional structure, preferably comprising a movable photoconductive belt. A transfer roller is typically provided between each fluidized bed and its associated applicator roller. The means for uniformly charging the charge retentive surface to a predetermined voltage level typically comprises a corona discharge device, such as a scorotron, corotron, or dicorotron, while the means for forming the charge retentive surface at different locations comprises a laser based output scanning device. All the other conventional components associated with a printer, such as means for transferring the first and second images from the charge retentive surface to a sheet of paper, cleaning apparatus, and the like, are also preferably provided.

According to still another aspect of the present invention, an image forming apparatus is provided comprising the following components: A movable charge retentive surface. Means for uniformly charging the charge retentive surface to a predetermined voltage level. Means for forming on the charge retentive surface at different locations thereof at least first and second different, spaced, latent electrostatic images. First and second spaced fluidized beds of non-magnetic toner. The first fluidized bed having a first, single, applicator roller. The second fluidized bed having a second, single, applicator roller. Means for moving the charge retentive surface first past the first fluidized bed of non-magnetic toner, so that the charge retentive surface comes into operative association with the first applicator roller, and then moving the charge retentive surface past the second fluidized bed of non-magnetic toner, so that the charge retentive surface comes into operative association with the second applicator roller. Means for electrically biasing the first fluidized bed and the first applicator roller. And, means for electrically biasing the second fluidized bed and the second applicator roller. The details of this apparatus are basically the same as described for the preceding embodiment.

It is the primary object of the present invention to multi-level imaging method and apparatus having a significantly enhanced performance window, and greater simplicity than is conventional. This and other objects of the invention will become clear from an inspection of the detailed description of the invention, and from the appended claims.

DETAILED DESCRIPTION OF THE DRAWINGS

Figure 1A:
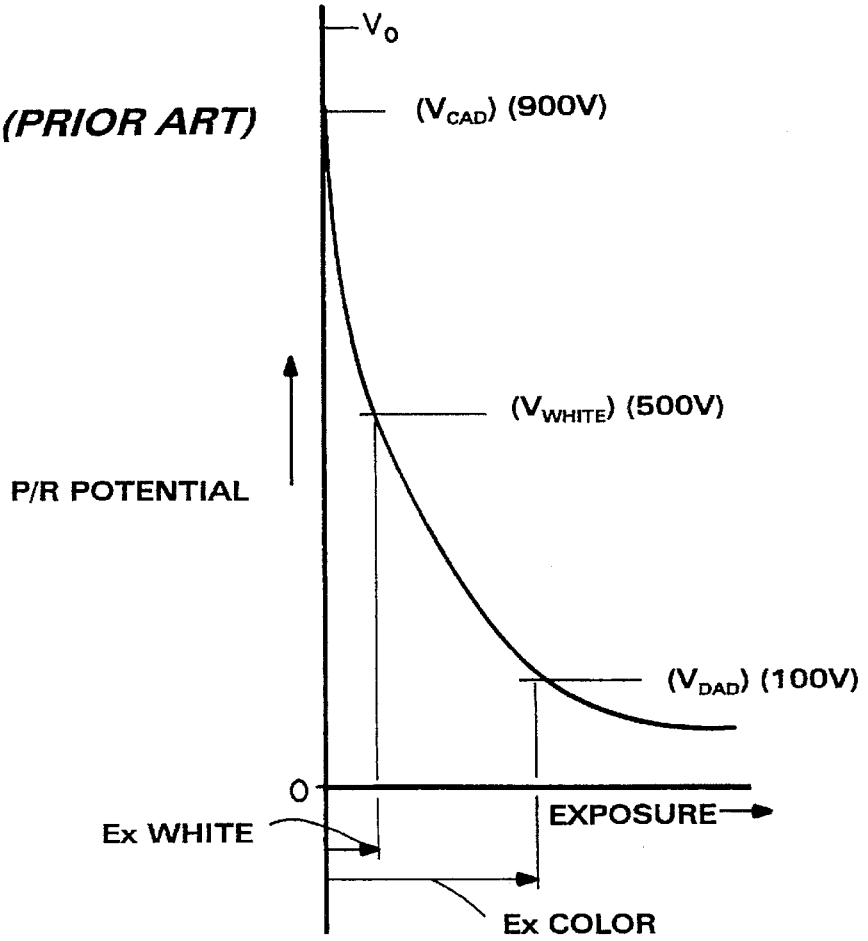
Fig. 1A (PRIOR ART)
FIG. 1A is a graphical representation of the prior art plot of electrical potential on a photo receptor against the amount of exposure from a writing laser beam in a multi-level imaging system.
Figure 1B:
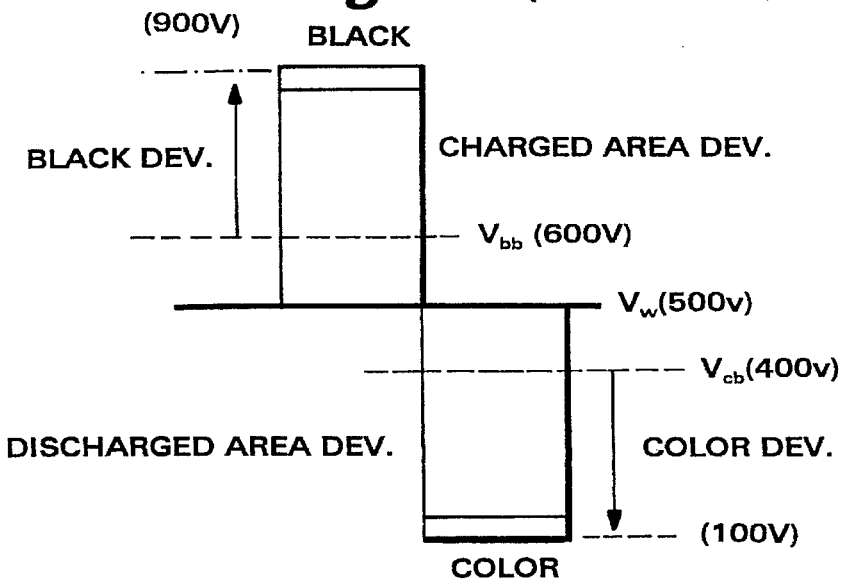
Fig. 1B (PRIOR ART)
FIG. 1B shows the particular levels of charge for two toned images from the plot of FIG. 1A of the prior art.

FIGS. 1A and 1B provide a graphical illustration of the voltage levels such as disclosed in the conventional multi-level imaging systems and processes as seen in U.S. Pat. Nos. 4,078,929 and 4,959,286. FIG. 1A plots the electrical potential on the photoreceptor (P/R) against the amount of exposure from the writing laser beam. Initially before exposure, the image belt is uniformly charged to a high potential of 900 volts with a corona device. At the writing station, the laser beam can be assigned to three different levels of exposure. The first level which may be called the "off" level does not expose the photoreceptor to any light. Here the charge is not erased and stays at a level of 900 volts or in the plot $V_{CAD}$. $V_{CAD}$ is Xerox Corporation terminology for "Charge Area Development". This means that this writing level is where the toner will develop to the non-erased or charged area on the image belt. The third level or "full on" level is where maximum exposure from the laser beam yields the maximum discharge of the image area. This exposure is labeled EX COLOR on the graph for the exposure level for color. With the full amount of exposure to the laser beam, the discharge occurs and erases the potential down to a level of about 100 V or in the plot $V_{DAD}$. $V_{DAD}$ is Xerox Corporation terminology for "Discharge Area Development". This imaging level is where the secondary or color toner will develop, to which is an erased or non-charged area. The second imaging level is the background area where there will be no imaging. The Xerox terminology for this is $V_{White}$. It is produced by giving the designated white areas a limited amount of laser power (EX WHITE), thus erasing only half of the charge level. This level happens to be at the mid-point of $V_{CAD}$ and $V_{DAD}$ at about 500 volts. The polarities of the particular potential are not important to the case presented as it will work both on the positive and negative sides.

FIG. 1B shows the particular levels of charge for the two toned images as well as where the applicator rollers are electrically biased at. The black toned area for Charged Area Development is resident at the high potential of 900 volts. The toner would be deposited into this area using electric field forces set up by the potential between the image at 900 volts and an applicator roller at a bias of 600 volts (Vbb). The reason Vbb is at 600 volts is to set up a reversing electric field between it and the background voltage $V_W$ (500 V) so the toner does not develop into the background regions. The black toner in this case would be negatively charged. In a like case, the color image would be developed by a positive toner with voltage potentials set up in an electrical mirror image around the background voltage $V_W$.

Figure 1C:
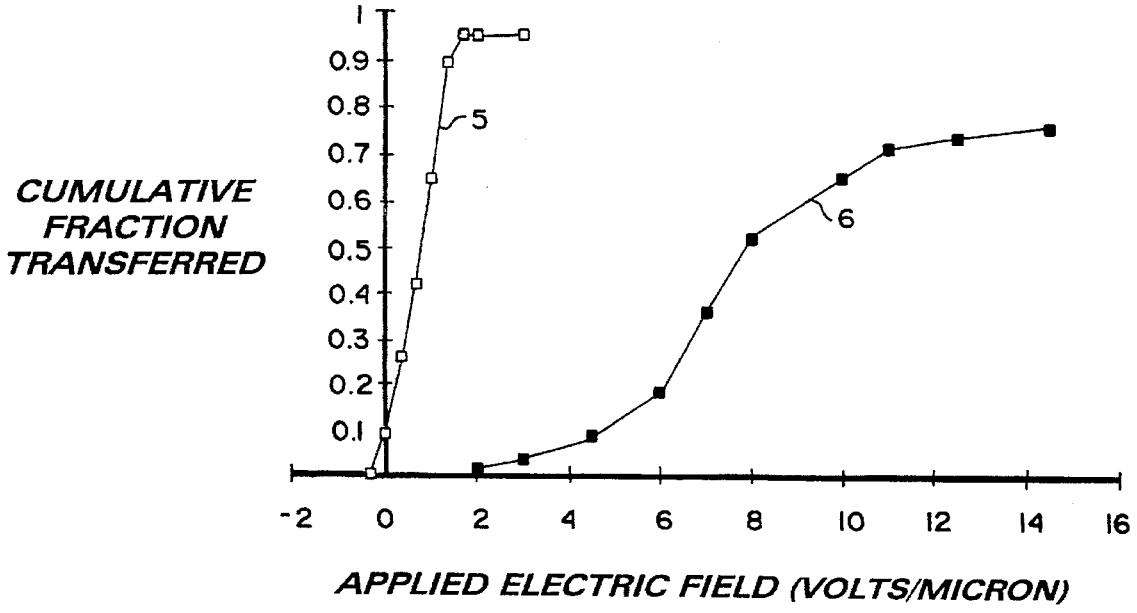
FIG. 1C is a schematic comparison of the graph of a conventional process versus the process according to the invention in which a cumulative fraction transferred is plotted against applied electric field.

FIG. 1C shows two different development curves for two different development processes, the process according to the prior art so being shown by the line 5, while a plot according to the present invention shown by line 6. The desirable high "gamma" for such development systems as suggested by U.S. Pat. No. 4,959,286 describes the slope in the middle part of the development curve, with a higher slope yielding a higher gamma. Curve 5 is plotted using data extracted from laboratory experiments using a dual prior art component development system, in an article entitled "Electrical Field Detachment of Charge Particles" by D. A. Hays, page 339, K. L. Mittal, Particles on Surface I, Plenum Press, New York, 1988. The data for curve 6 is taken from laboratory experiments for a system and method according to the present invention. The higher gamma of the curve 6 compared to the curve 5 is apparent, indicating that the non-magnetic toning process and apparatus as described in Canadian 2059036 is well suited for use in multi-level imaging. By utilizing the development system and method according to the present invention it is possible to eliminate special AC electrodes above the donor rollers which increase the effective gamma of the development systems in the prior art, such AC electrodes causing AC fields which disturb the toner and create a problem of powder cloud.

Figure 2:
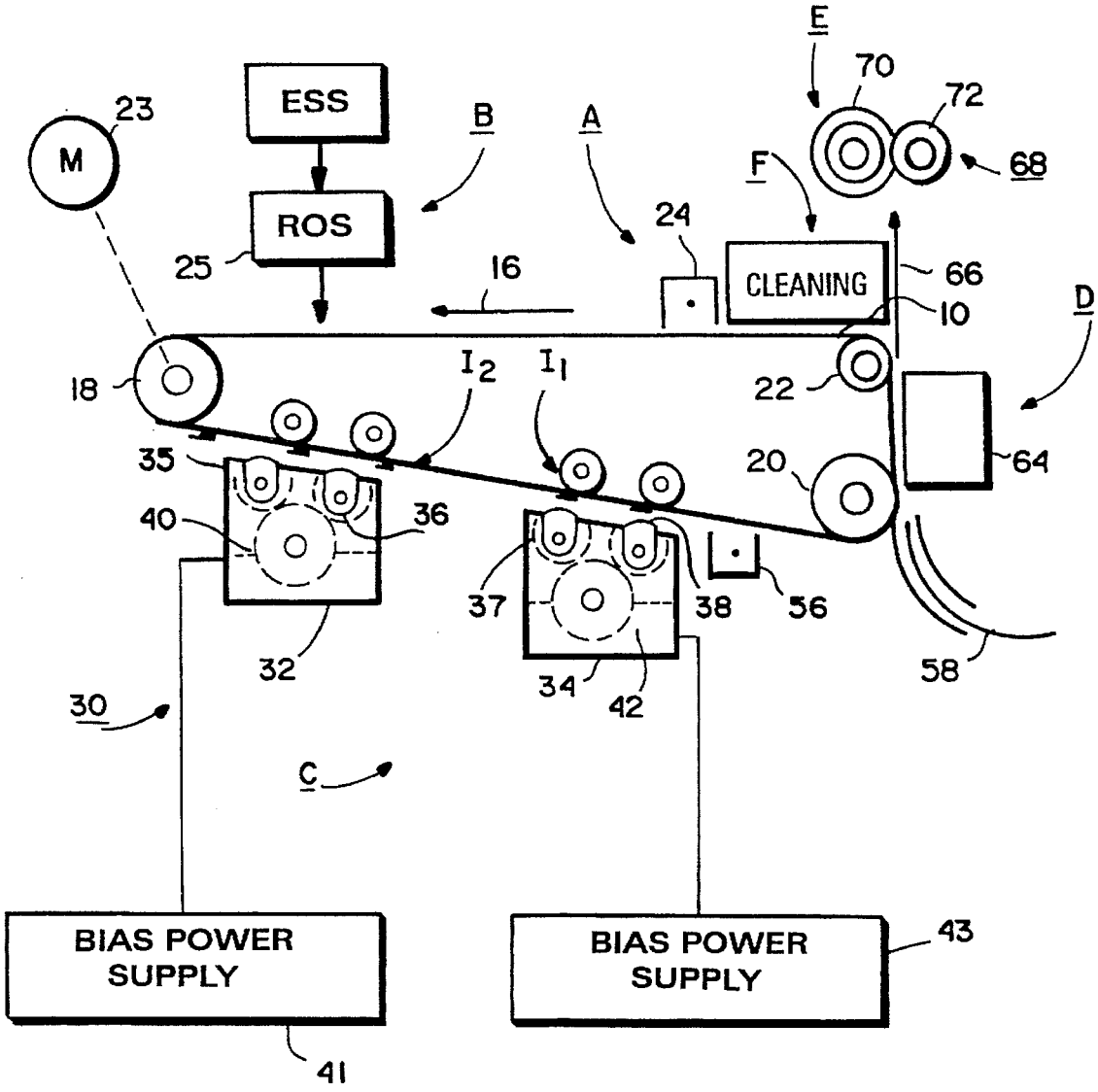
Fig. 2 (PRIOR ART)
FIG. 2 is a schematic representation of a conventional tri-level printing engine of the prior art.

An exemplary prior art tri-level printing machine is seen in FIG. 2, and is disclosed completely in U.S. Pat. No. 4,959,286. The machine of FIG. 2 uses a charge retentive surface preferably in the form of a photoconductive belt 10 which consists of a photoconductive surface and electrically conductive substrate which are mounted for movement past a charging station A, an exposure station B, developer station C, transfer station D and cleaning station F. Belt 10 moves in the direction of arrow 16 to advance successive portions thereof sequentially through the various processing stations disposed about the path of movement thereof. Belt 10 is entrained about a plurality of rollers 18, 20 and 22, the former of which can be used as a drive roller and the latter of which can be used to provide suitable tensioning of the photoreceptor belt 10. Motor 23 rotates roller 18 to advance belt 10 in the direction of arrow 16. Roller 18 is coupled to motor 23 by suitable means such as a belt drive.

Initially successive portions of belt 10 pass through charging station A. At charging station A, a corona discharge device such as a scorotron, corotron or dicorotron indicated generally by the reference numeral 24, charges the belt 10 to a selectively high uniform positive or negative potential, $V_O$. Any suitable control, well known in the art, may be employed for controlling the corona discharge device 24.

Next, the uniformly charged portions of the photoreceptor surface 10 are advanced through exposure station B. At exposure station B, the uniformly charged photoreceptor or charge retentive surface 10 is exposed to a laser based output scanning device 25 which causes the charge retentive surface to be discharged in accordance with the output from the scanning device. Preferably the scanning device is a two level laser Raster Output Scanner (ROS).

At development station C, a development system, indicated generally by the reference numeral 30 advances developer materials into contact with the electrostatic latent images. The development system 30 comprises first and second developer apparatuses 32 and 34.

The developer apparatus 32 comprises a housing containing a pair of magnetic brush rollers 35 and 36. The rollers advance developer material 40 into contact with the photoreceptor for developing the charged areas of image $I_1$. The developer material 40 by way of example contains positively charged black toner. Electrical biasing is accomplished via power supply 41 electrically connected to developer apparatus 32. E.g. a DC bias of approximately −150 to −200 volts is applied to the rollers 35 and 36 via the power supply 41 when so image $I_1$ passes through the development zone between the development apparatus 32 and the photoreceptor. When image $I_2$ passes through this development zone the basis on the development apparatus 32 is switched to a voltage level of −800 to −850 volts to thereby preclude development of that image.

The developer apparatus 34 comprises a housing containing a pair of magnetic brush rolls 37 and 38. The rollers advance developer material 42 into contact with the photoreceptor for developing the discharged area images of $I_2$. The developer material 42 by way of example contains negatively charged color toner for developing the discharged-area images. Appropriate electrical biasing is accomplished via power supply 43 electrically connected to developer apparatus 34. A suitable DC bias of approximately −650 to −700 volts is applied to the rollers 37 and 38 via the bias power supply 43 when image $I_2$ passes through the development zone between the development apparatus 34 and the photoreceptor 10. When image $I_1$ passes this development zone the bias on the development apparatus 34 is switched to −0 to −50 volts to thereby preclude development of that image.

A sheet of support material 58 (e.g. paper sheet) is moved into contact with the toner images at transfer station D. The sheet of support material 58 is advanced to transfer station D by conventional sheet feeding apparatus, not shown. Preferably, the sheet feeding apparatus includes a feed roll contacting the uppermost sheet of a stack copy sheets. Feed rolls rotate so as to advance the uppermost sheet from stack into a chute which directs the advancing sheet of support material into contact with photoconductive surface of belt 10 in a time sequence so that the toner powder image developed thereon contacts the advance sheet of support material at transfer station D.

At the transfer station D, two images $I_1$ and $I_2$ are sequentially transferred to a support sheet 58 to form the final image. Any suitable transfer device 64 is used for effecting sequential transfer of the images, $I_1$ and $I_2$ to the support sheet 58. The transfer device 64 causes the support to contact the photoreceptor a first time for transferring the image $I_1$ and a second time for transfer of image $I_2$.

After transfer, the sheet 58 continues to move, in the direction of arrow 66, onto a conveyor (not shown) which advances the sheet 58 to fusing station E.

Fusing station E includes a fuser assembly, indicated generally by the reference numeral 68, which permanently affixes the transferred powder images to a copy substrate (paper sheet) 58. Preferably, fuser assembly 68 comprises a heated fuser roller 70 and a backup roller 72. Sheet 58 passes between fuser roller 70 and backup roller 72 with the toner powder image contacting fuser roller 70. In this manner, the toner powder images are permanently affixed to sheet 58. After fusing, a chute, not shown, guides the advancing sheet 58 to a catch tray, also not shown, for subsequent removal from the printing machine by the operator.

After the sheet of support material 58 is separated from photoconductive surface of belt 10, the residual toner particles carried by the non-image areas on the photoconductive surface 10 are removed therefrom. These particles are removed at cleaning station F. A magnetic brush cleaner housing is disposed at the cleaner station F. The cleaner apparatus comprises a conventional magnetic brush roll structure for causing carrier particles in the cleaner housing to form a brush-like orientation relative to the roll structure and the charge retentive surface. It also includes a pair of detoning rolls for removing the residual toner from the brush. Other cleaners such as a fur brush, may alternatively or also be used.

Subsequent to cleaning, a discharge lamp (not shown) floods the photoconductive surface 10 with light to dissipate any residual electrostatic charge remaining prior to the charging thereof for the successive imaging cycle.

Figure 3:
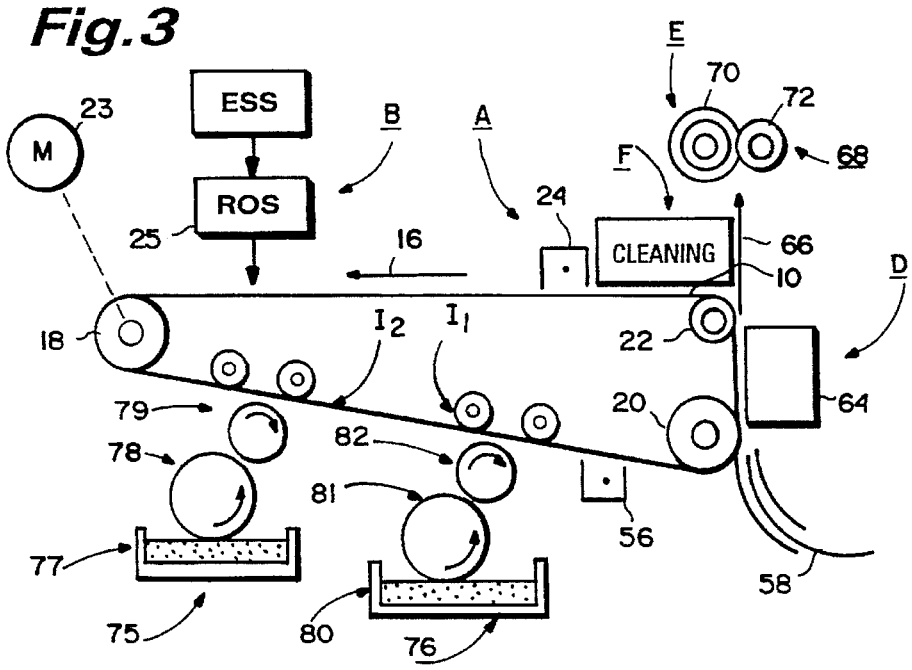
FIG. 3 is a schematic representation like that of FIG. 2 only for a tri-level printing engine according to the invention.
Figure 4:
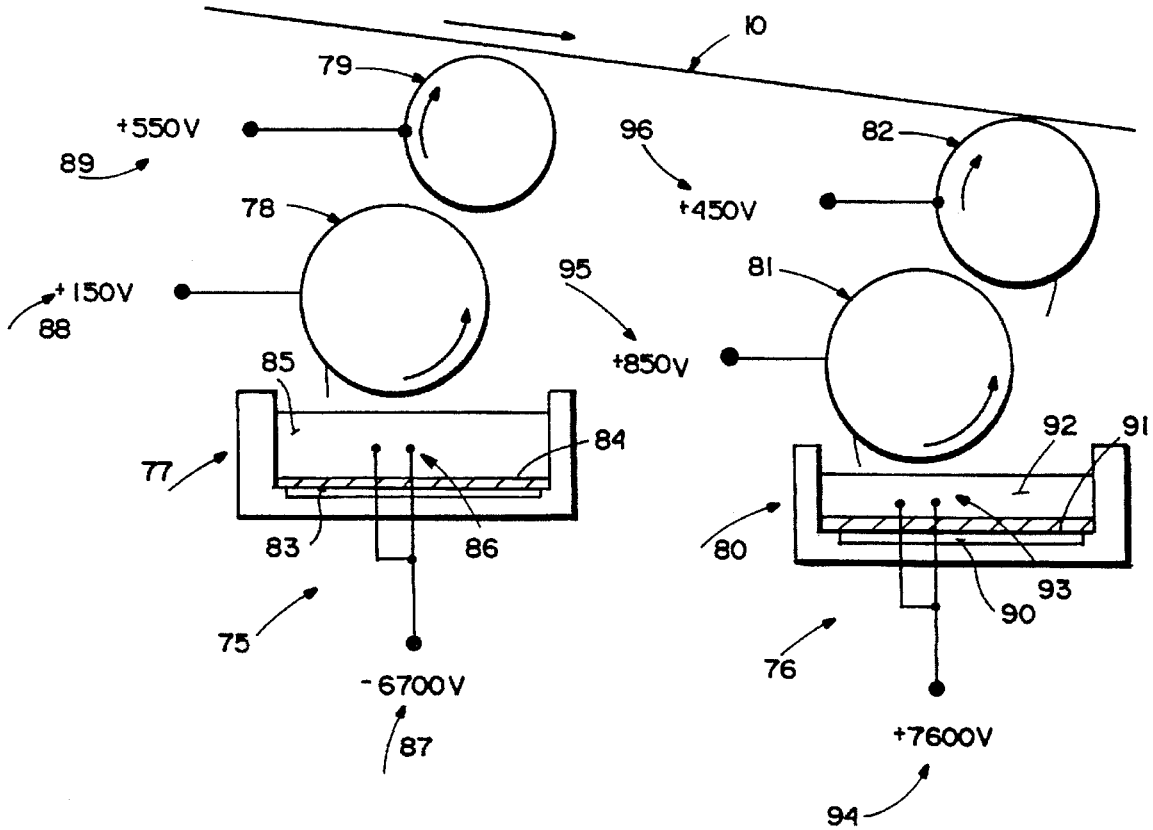
FIG. 4 is a detail side schematic view of the developing stations of the system of FIG. 3.

Apparatus according to the present invention is schematically illustrated in FIGS. 3 and 4. The apparatus of FIGS. 3 and 4 is the same as that of FIG. 2 except for the development stations 75, 76. Therefore other components are shown by the same reference numerals as in the FIG. 2 embodiment, although clearly a wide variety of other types of components may be utilized instead of those specifically illustrated. Also more than two development stations 75, 76 may be provided. The system in FIG. 4 is a typical system for fixed imaging speeds of about 60 pages per minute.

The station 75 includes a fluidized bed 77 of non-magnetic toner, as disclosed in Canadian 2059036, with a transfer roller 78 and a single applicator roller 79. Similarly, the second development station 76 includes a second fluidized bed 80 having a transfer roller 81 and a second, single, applicator roller 82. The stations 75, 76 are shown in more detail in FIG. 4.

In FIG. 4 fluidizing gas, such as air, is introduced into the fluidized bed 77, for example through a side wall or the bottom wall into the chamber 83 so that the gas flows upwardly through the air pervious false bottom 84 into the powdered non-conductive and non-magnetic toner 85 within the fluidized bed 77. The fluidized toner 85 is charged by a corona generating device or devices 86, for example in the embodiment illustrated in FIG. 4 held at −6700 volts by the power source 87. The corona generating device or devices 86 may comprise any suitable device, including the rotating elements with sharply pointed blades such as illustrated in Canadian 2059036, or stationary devices.

The corona device or devices 86 charge the toner 85 particles negatively. The toner particles are transported via electric field forces to the transfer roller 78 peripheral surface, the roller 78 being held—in the embodiment illustrated in FIG. 4—at an electrical bias of +150 volts, as indicated by the power source 88 in FIG. 4. The toner particles are held to the roller 78 surface by electrostatic adhesion forces until they come into opposition with the applicator roller 79, which is held at an electrical potential—in this embodiment—of +550 volts, as indicated by power source 89. The toner is transferred between the two opposing direction of rotation rollers 78, 79 by electrical field forces created by the 400 volt potential difference between the rollers 78, 79 (+550—+150). The toner is then transported by the surface of the applicator roller 79 until it comes into operative association with the positive image on the imaging belt/charge retentive surface 10, at which point it is dynamically transported to the belt 10.

The second developing station 76 is similar to the station 75 except for the particular voltages applied. The fluidized bed 80 includes a chamber 90 into which the fluidizing gas is passed, then passing through the air pervious false bottom 91 into the fluidized bed of toner 92, fluidized toner 92 being charged by the corona device or devices 93 being electrically biased by the power source 94 to, for example, +7600 volts. The power source 95 biases the transfer roller 81 to +850 volts, while the power source 96 biases the second applicator roller 82 to +450 volts. The toner particles in bed 92 are positively charged and are transferred by electrical field forces first to the transfer roller 81 and then to the applicator roller 82, the applicator roller 82 bringing the positive toner into close opposition (operative association with) the negative images on the imaging belt 10 to which they are transferred.

While specific field and charge levels are given above, it should be understood that those are only indicative of the relative levels most likely needed for a tri-level system. They are only approximate levels, and they are all variable and could even be made to work with a variable speed system by simply using a speed tracking voltage source to drive each of the high voltage corona sources 86, 93 depending upon the speed of the belt 10 and the number of pages per minute to be printed.

FIGS. 5A–5E schematically illustrate the mechanism of tri-level development utilizing the apparatus according to the invention as seen in FIGS. 3 and 4, and practicing the method according to the invention. Before the image belt 10 reaches the first toning station 75 the electrical structure of the latent image shows the three levels of potential, as seen from the prior art of FIG. 1B.

Figure 5A:
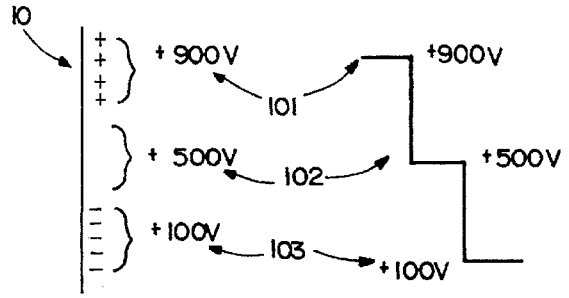
FIGS. 5A–5E are schematic representations illustrating the operation of the developing stations of FIG. 4 in a method according to the present invention.

FIG. 5A shows the electrical image structure of the image belt 10 before entry into the developing stations 75 and 76. The three regions of electrical potential on the belt 10 represent the tri-levels of imaging which were created at the imaging station B, by modulating the writing laser beam 25 to three levels of exposure. Region 101 represents the high charge region which will be developed with the negatively charged black toner. Region 103 represents the low charge region shown as a negative region. Even though the potential level in this region is +100 volts, it is represented as a negative image because on a relative basis, this is the most negative region and will ultimately be developed by the positive color toner. The final region 105 is at the intermediate potential of 500 volts and represents the background, non-imaged, or "white" area.

Figure 5B:
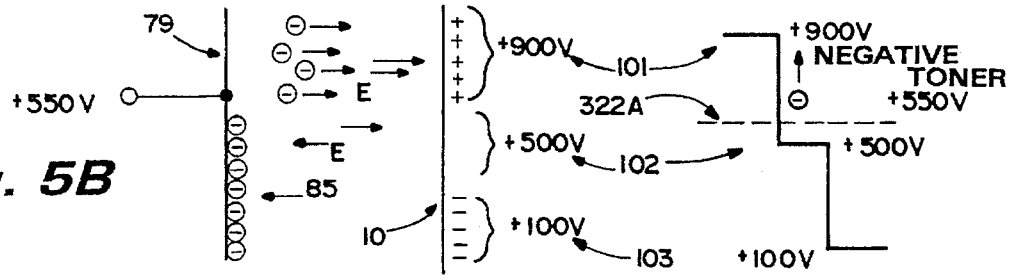

FIG. 5B represents the image belt 10 with its electrostatic images 101–103 in direct opposition to the first applicator roller 79 of development system 75. Negative toner 85 is formed into a mono-layer thickness on the surface of the roller 79 by the process described above. Roller 79 is biased to a level of +550 volts by the power source 89. Negative toner in opposition to the 900 volt area is driven to this area by the electrostatic forces involved between the roller 79 and image caused by the electric field E this region. Here the orientation of the E vector is such that the toner 85 is removed from the roller 79 by the action of the electric field force and transported to the image region 101. In the regions of the non-image potential 102 and the negative toner image 103, the toner 85 remains on the roller surface 79. Here, with a reversal in the potential difference, the orientation of the electric field vector E is in the direction which would further force the toner 85 to remain on the roller 79.

Figure 5C:
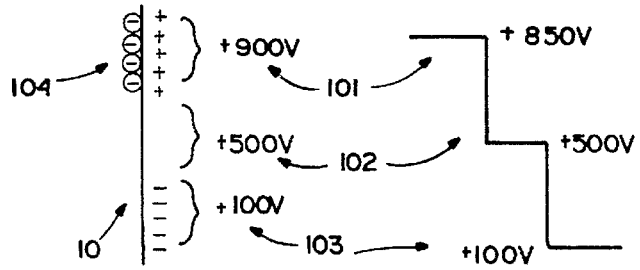

FIG. 5C illustrates the image structure as found on belt 10 between the two developing stations 75, 76. The negative toner 104 adheres to the positive image area 101 on the belt. The other two image areas 102 and 103 are unaffected by the passage through the first developing station 75. The layer of toner 104 will actually change the voltage potential above region 101 slightly because of the negative charge on the toner. If one were to measure this region with a non-contact electrostatic voltmeter, a surface potential of approximately +850 volts would be measured.

Figure 5D:
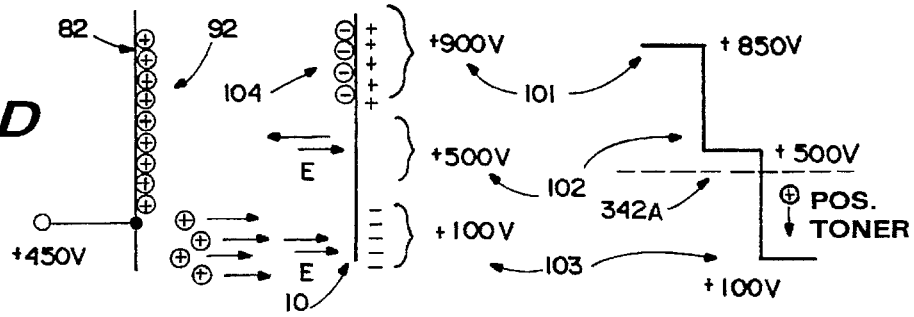

FIG. 5D represents the structure of the image belt 10 when in opposition to the second development system 76. In a structure like that of FIG. 5B, positive toner 92 is formed in a mono-layer on the roller 82. Held at an electrical potential of 450 volts, the positively charged toner 92 is transported to the relatively negative region of charge 103. Because the other two regions of charge 101 and 102 are more positive than the roller 82, the electric field vector E would be reversed in these regions, thus preventing toner transfer from the roller 82.

Figure 5E:
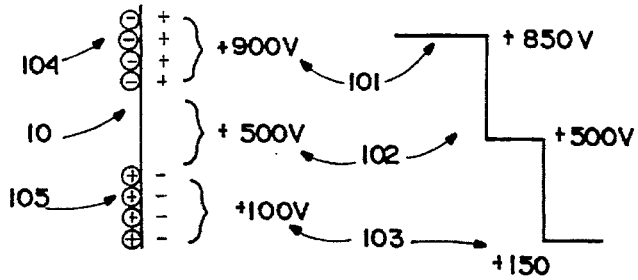

FIG. 5E shows the structure of the belt 10 after development by the two toners in development systems 75 and 76. Negative black toner 104 and positive color toner 105 are held to the imaging belt 10 by the electrostatic Coulombic forces from the charged regions 101 and 103 respectively. The background or white region 102 has no toner developed in the region.

While the above system and method are preferred, a similar application to that found in U.S. Pat. No. 4,959,286 may be provided in which there is developer housing bias switching. This could be achieved by using applicator/transfer roller bias switching in the nonmagnetic toner development systems as described above.

It will thus be seen that according to the present invention an imaging method and apparatus are provided which can significantly enhance the performance window of conventional multi-level imaging processes, utilizing simpler components. While the invention has been herein shown and described in what is presently conceived to be the most practical and preferred embodiment it will be apparent to those of ordinary skill in the art that many modifications may be made thereof within the scope of the invention, which scope is to be accorded the broadest interpretation of the appended claims so as to encompass all equivalent methods and apparatus.

What is claimed is:

1. A method of forming images, using first and second fluidized beds of non-magnetic toner, having first and second, respective, applicator rollers, comprising the steps of substantially continuously:

(a) uniformly charging a charge retentive surface to a predetermined voltage level;

(b) forming on the charge retentive surface at different locations thereof at least first and second different, spaced, latent electrostatic images;

(c) moving the charge retentive surface past the first fluidized bed of non-magnetic toner, so that the charge retentive surface comes into operative association with the first applicator roller of the first fluidized bed;

(d) electrically biasing the first fluidized bed and the first applicator roller at a first bias level effective so that the first image is developed by non-magnetic toner transferred from the first applicator roller to the first image while development of the second image is precluded;

(e) moving the charge retentive surface past the second fluidized bed of non-magnetic toner, so that the charge retentive surface comes into operative association with the second applicator roller of the second fluidized bed; and (f) electrically biasing the second fluidized bed and the second applicator roller at a second bias level, different than the first bias level of step (d), effective so that the second image is developed by non-magnetic toner transferred from the second applicator roller to the second image while development of the first image is precluded.

2. A method as recited in claim 1 wherein each fluidized bed of non-magnetic toner has a single applicator roller, and wherein step (c) is practiced by bringing the charge retentive surface into operative association with the first, single, applicator roller, and step (e) is practiced by bringing the charge retentive surface into operative association with the second, single, applicator roller.

3. A method as recited in claim 2 wherein step (d) is practiced to apply a first positive voltage to the first applicator roller, and step (f) is practiced to apply a second positive voltage to the second applicator roller, the second voltage at least about 50 volts lower than the first voltage.

4. A method as recited in claim 2 comprising the further step, for at least one of the fluidized beds, of using a transfer roller to transfer toner from the fluidized bed to the applicator roller.

5. A method as recited in claim 1 wherein step (d) is practiced by applying an electrical bias to the first fluidized bed of toner of a first polarity, and step (f) is practiced by applying an electrical bias to the second fluidized bed of toner of a second polarity.

6. A method as recited in claim 5 wherein step (d) is practiced to applying a negative electrical bias to the first fluidized bed, and step (f) to apply a positive electrical bias to the second fluidized bed.

7. A method as recited in claim 6 wherein steps (c) and (d) are practiced to apply and develop black toner, and steps (e) and (f) to apply and develop colored toner.

8. A method as recited in claim 6 wherein each fluidized bed of non-magnetic toner has a single applicator roller, and wherein step (c) is practiced by bringing the charge retentive surface into operative association with the first, single, applicator roller, and step (e) is practiced by bringing the charge retentive surface into operative association with the second, single, applicator roller.

9. A method as recited in claim 1 wherein stops (c) and (d) are practiced to apply and develop black toner, and steps (e) and (f) to apply and develop colored toner.

10. A method as recited in claim 1 wherein step (d) is practiced to apply a negative voltage of about 6700 volts to the first fluidized bed, and a positive voltage of about 550 volts to the first applicator roller, and step (f) is practiced to apply a positive voltage of about 7600 volts to the second fluidized bed and a positive voltage of about 450 volts to the second applicator roller.

11. Image forming apparatus, comprising:

a movable charge retentive surface;

means for uniformly charging said charge retentive surface to a predetermined voltage level;

means for forming on said charge retentive surface at different locations thereof at least first and second different, spaced, latent electrostatic images;

first and second spaced fluidized beds of non-magnetic toner, having first and second, respective, applicator rollers;

means for moving said charge retentive surface first past said first fluidized bed of non-magnetic toner, so that said charge retentive surface comes into operative association with said first applicator roller, and then moving said charge retentive surface past said second fluidized bed of non-magnetic toner, so that said charge retentive surface comes into operative association with said second applicator roller;

means for electrically biasing said first fluidized bed and said first applicator roller at a first bias level effective so that the first image is developed by non-magnetic toner transferred from said first applicator roller to the first image while development of the second image is precluded; and means for electrically biasing said second fluidized bed and said second applicator roller at a second bias level, different than the first bias level, effective so that the second image is developed by non-magnetic toner transferred from said second applicator roller to the second image while development of the first image is precluded.

12. Apparatus as recited in claim 11 wherein said first applicator roller comprises a single applicator roller associated with said first fluidized bed, and wherein said second applicator roller comprises a single applicator roller associated with said second fluidized bed.

13. Apparatus as recited in claim 12 wherein said movable charge retentive surface comprises a movable photoconductive belt.

14. Apparatus as recited in claim 12 further comprising a transfer roller between each of said fluidized bed and its associated applicator roller.

15. Apparatus as recited in claim 11 wherein said means for uniformly charging said charge retentive surface to a predetermined voltage level comprises a corona discharge device; and wherein said means for forming on said charge retentive surface at different locations thereof at least first and second different, spaced, latent electrostatic images comprises a laser based output scanning device.

16. Apparatus as recited in claim 15 further comprising means for transferring the first and second images from said charge retentive surface to a sheet of paper.

17. Image forming apparatus, comprising:

a movable charge retentive surface;

means for uniformly charging said charge retentive surface to a predetermined voltage level;

means for forming on said charge retentive surface at different locations thereof at least first and second different, spaced, latent electrostatic images;

first and second spaced fluidized beds of non-magnetic toner;

said first fluidized bed having a first, single, applicator roller;

said second fluidized bed having a second, single, applicator roller;

means for moving said charge retentive surface first past said first fluidized bed of non-magnetic toner, so that said charge retentive surface comes into operative association with said first applicator roller, and then moving said charge retentive surface past said second fluidized bed of non-magnetic toner, so that said charge retentive surface comes into operative association with said second applicator roller;

means for electrically biasing said first fluidized bed and said first applicator roller; and means for electrically biasing said second fluidized bed and said second applicator roller.

18. Apparatus as recited in claim 17 wherein said movable charge retentive surface comprises a photoconductive movable belt.

19. Apparatus as recited in claim 17 further comprising a transfer roller between each of said fluidized bed and its associated applicator roller.

20. Apparatus as recited in claim 17 wherein said means for uniformly charging said charge retentive surface to a predetermined voltage level comprises a corona discharge device; and wherein said means for forming on said charge retentive surface at different locations thereof at least first and second different, spaced, latent electrostatic images comprises a laser based output scanning device.

* * * * *